US006252486B1

(12) United States Patent
Wolf

(10) Patent No.: US 6,252,486 B1
(45) **Date of Patent: *Jun. 26, 2001**

(54) PLANAR WINDING STRUCTURE AND LOW PROFILE MAGNETIC COMPONENT HAVING REDUCED SIZE AND IMPROVED THERMAL PROPERTIES

(75) Inventor: Ronald Wolf, Katonah, NY (US)

(73) Assignee: Philips Electronics North America Corp., New York, NY (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/874,171

(22) Filed: Jun. 13, 1997

Related U.S. Application Data

(63) Continuation of application No. 08/874,171, filed on Jun. 13, 1997.

(51) Int. Cl.[7] ..... H01F 5/00; H01F 27/29
(52) U.S. Cl. ..... 336/200; 336/192; 336/232
(58) Field of Search ..... 336/192, 200, 336/232

(56) References Cited

U.S. PATENT DOCUMENTS

| | | | | |
|---|---|---|---|---|
| 3,483,499 | * | 12/1969 | Lugten | 336/200 |
| 3,848,210 | * | 11/1974 | Felkner | 336/232 |
| 4,201,965 | * | 5/1980 | Onyshkevych | 336/200 |
| 4,547,961 | * | 10/1985 | Bokil et al. | 336/200 |
| 5,386,206 | * | 1/1995 | Iwatani et al. | 336/200 |
| 5,521,573 | * | 5/1996 | Inoh et al. | 336/200 |
| 5,598,135 | | 1/1997 | Maeda et al. | 336/200 |

FOREIGN PATENT DOCUMENTS

| | | | | |
|---|---|---|---|---|
| 4422827 A1 | | 1/1995 | (DE) . | |
| 5-36537 | * | 2/1993 | (JP) | 336/200 |
| 6-163266 | * | 6/1994 | (JP) | 336/200 |

* cited by examiner

*Primary Examiner*—Anh Mai
(74) *Attorney, Agent, or Firm*—Leroy Eason

(57) ABSTRACT

A low profile magnetic component such as an inductor or transformer includes a core and a planar magnetic winding body having a dense, rigid structure composed of a stack of individual winding patterns separated by insulating layers, and a binder/filler material. The input and output termini of the individual winding patterns are revealed in a side face of the winding body, where they are interconnected with a plated metallization. Such structures may be mounted onto a PC board, and are useful, for example, in electronic ballasts for the lighting industry.

16 Claims, 2 Drawing Sheets

PLANAR WINDING STRUCTURE AND LOW PROFILE MAGNETIC COMPONENT HAVING REDUCED SIZE AND IMPROVED THERMAL PROPERTIES

CROSS REFERENCE TO RELATED APPLICATIONS

This is a continuation divisional of application Ser. No. 08/874,171, filed Jun. 13, 1997.

BACKGROUND OF THE INVENTION

This invention relates to low profile magnetic components, and more particularly relates to such components including planar magnetic winding structures, such as inductors and transformers, in which the windings are composed of stacks of interconnected layers of conductor patterns.

The main use for such planar magnetic components is in electronic circuitry destined for use in a volume restricted space, ie, reduced height and/or reduced total volume.

Such structures consist of a stack of layers each containing part of the total winding structure, an insulating layer to prevent electrical contact between turns in adjacent layers, and a contacting structure that permits electrical contact between turns in adjacent layers. The winding structures are optimized with respect to winding losses, and usually are made by etching or stamping, and sometimes by folding. Contacts are usually made by soldering or using plated vias.

For example, the winding patterns may be formed by selectively etching a copper layer having a thickness of about 3 mils, from a PC board having a thickness of about 4 mils. The etched PC boards are then stacked to form the winding structure.

As such components are reduced in size to meet new miniaturized device requirements, the surface-to-volume ratio becomes smaller and the temperature due to heat dissipation quickly rises with the amount of dissipated heat. In present planar winding structures, such heat dissipation is hindered by the presence of voids between the layers and the windings of each layer, as well as by irregular outer surfaces of the structure, which prevents good thermal contact with surrounding structures. In addition, the layer-to-layer contacts become more difficult to achieve.

In DE 44 22 827 A1, to which U.S. Pat. No. 5,652,561 corresponds, the voids between winding layers of a planar magnetic winding structure are filled with glue, but the interconnections are achieved using vias. Such vias constitute a larger proportion of the total winding structure, which can contribute significantly to eddy current losses and other magnetic winding losses.

In U.S. Pat. No. 5,598,135, some of the interconnections between winding layers of a planar winding structure are achieved by brazing over connector portions of the windings which terminate in the outer surface of the stack. Such brazing is enabled by the use of a rigid ceramic composition as the insulating portion of the winding layers. However, vias must still be used to establish interconnections in the interior of the stack. Such a complex structure tends to be difficult and costly to manufacture.

OBJECTS AND SUMMARY OF THE INVENTION

Accordingly, it is an object of the invention to provide a planar magnetic winding structure for a low profile magnetic component which is compact.

It is another object of the invention to provide such a the winding layers are readily interconnected.

It is another object of the invention to provide such a planar magnetic winding structure which can be readily connected to external circuitry.

It is yet another object of the invention to provide such a planar magnetic winding structure which is readily manufacturable, and does not deform during manufacturing.

It is yet another object of the invention to provide a low profile magnetic component incorporating such a planar winding structure.

According to the invention, there is provided a planar winding body for a low profile magnetic component, the winding body having upper and lower surfaces, an outer sidewall, and an inner sidewall defining an aperture the body comprising a stack of substantially planar layers of an electrically insulating material, each layer bearing a winding pattern formed by a continuous track of electrically conductive material, the input and output termini of the individual tracks revealed in sidewalls of the winding body, an electrically insulating binding material filling the spaces between turns of the tracks, and metal pattern on the side walls of the body, the metal providing interconnection of the input and output termini of the winding patterns as well as contacts for external electrical connections.

Preferably, the metal paterns are plated, most preferably, electroless plated. A typical and preferred winding material is copper, while the insulating material may be a dielectric polymer such as a polyimide, and a typical suitable filler/binder material is a dielectric thermosetting resin such as epoxy.

In order to maintain planarity of the device during manufacture and thereafter, pads of conductive material of the same thickness as the winding pattern are preferably positioned between the winding pattern and the edges of the layers. Such pads provide support during filling of the voids in the stack and thus prevent loss of filler due to deformation during pressing and curing of the stack to densify and rigidify the structure.

In accordance with another aspect of the invention, there is provided a low profile magnetic component comprising a core and the winding body of the invention.

Preferably, the core comprises two or more core components having mutually facing planar surfaces. In one embodiment, the core comprises a first lower core component having a planar portion and two or more spaced-apart upstanding portions having planar upper surfaces, the upstanding portions defining a space to accommodate the winding body, the core also comprising a second upper core component having a planar lower surface.

In an especially preferred embodiment of the invention, two opposite sides of the winding body have indented portions for accommodating the upstanding portions of the core, and for establishing a predetermined distance between the body and the core, thereby to insure a minimum distance between the contacts on the inner face of the winding body and the adjacent core surface, for electrical isolation purposes.

The planar winding structures of the invention are useful in a variety of applications, such as transformers, inductors, motor windings, planar engines, antennas and detectors.

DESCRIPTION OF THE PREFERRED EMBODIMENTS

Figure 1A:
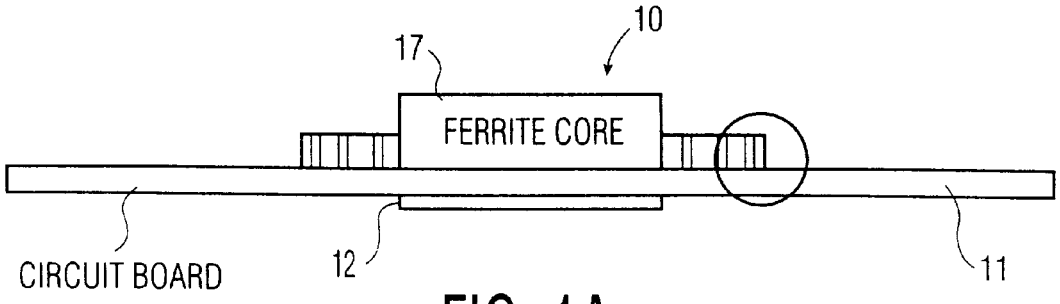
FIG. 1*a* is a side elevation view of a low profile magnetic component including a planar magnetic winding structure of the invention, mounted on a circuit board.

The invention will now be further elucidated by a detailed description of certain preferred embodiments of the invention, in conjunction with the drawings, in which the same reference numerals are used to indicate similar features or elements in different figures.

Figure 1B:
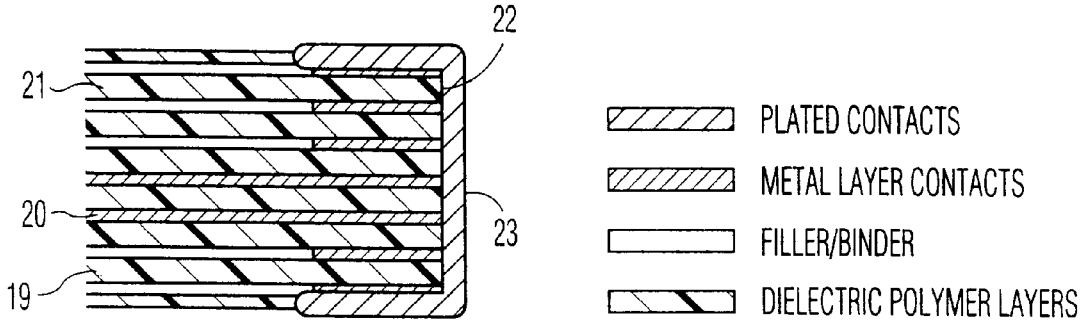
FIG. 1*b* is a side view of a portion of the planar magnetic winding structure of FIG. 1*a;*
Figure 1C:
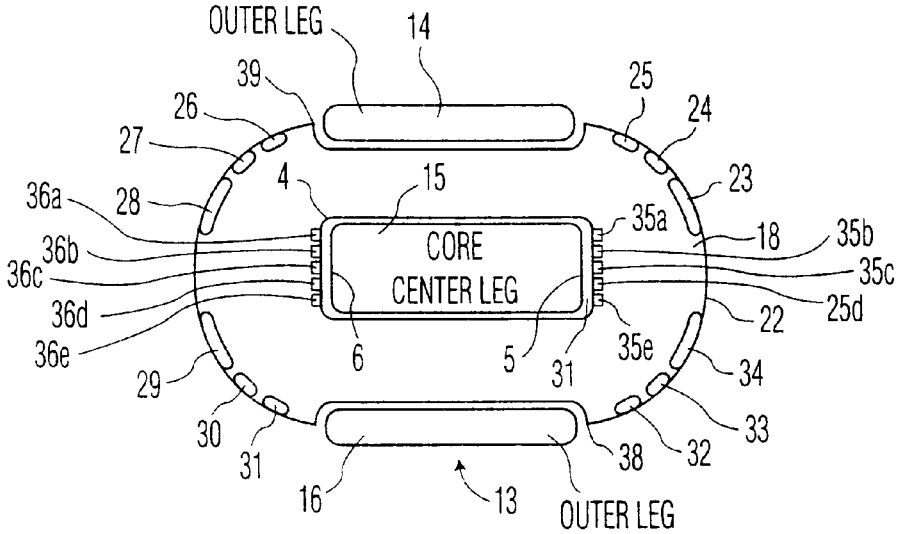
FIG. 1*c* is a top view of the planar magnetic component of FIG. 1*a*.

Referring now to FIGS. 1*a* through 1*c*, there is illustrated a low profile inductor component 10 of the invention, mounted on a circuit board 11. The component 10 includes a composite ferrite core made up of a lower "E" core 13, so named for the E-shape resulting from the upstanding portions 14, 15 and 16 on the base portion 12, and a top "I" core 17, having a planar configuration.

Arranged in the spaces between the upstanding portions 14, 15 and 16 of the core is a winding body 18, having a central aperture consisting of a stack of winding layers, each layer being made up of a polyimide substrate 19, and an electrically conductive winding pattern 20. Filling the spaces between the turns of continuous conductive track 20 of the winding pattern and binding the stack into a dense, rigid body is a binder/filler material such as an epoxy 21.

As best seen in FIG. 1*b*, at least a terminal portion of the conductive track 20 in each layer extends into the outer sidewall 22 of winding body 18, where they are interconnected by means of a metal pattern, eg., electroless plated metal contacts 23–34 covering the ends of the tracks 20 in the outer sidewall 22 and extending partially onto the upper and lower surfaces of the body 10. One such contact 23 is shown in the FIG. 1*b*, while the remaining contacts 24 through 34 are shown in FIG. 1*c*. These plated contacts 23–34 also are used for external connection to the winding body 18. Additional plated contacts 35*a*–35*e* and 36*a*–36*e* are located on the inner sidewall 4 defining the aperture of body 18 adjacent the end walls 5 and 6 of center leg 15 of core 13. These contacts also serve to interconnect the winding layers, as well as to provide external connections.

Figure 2:
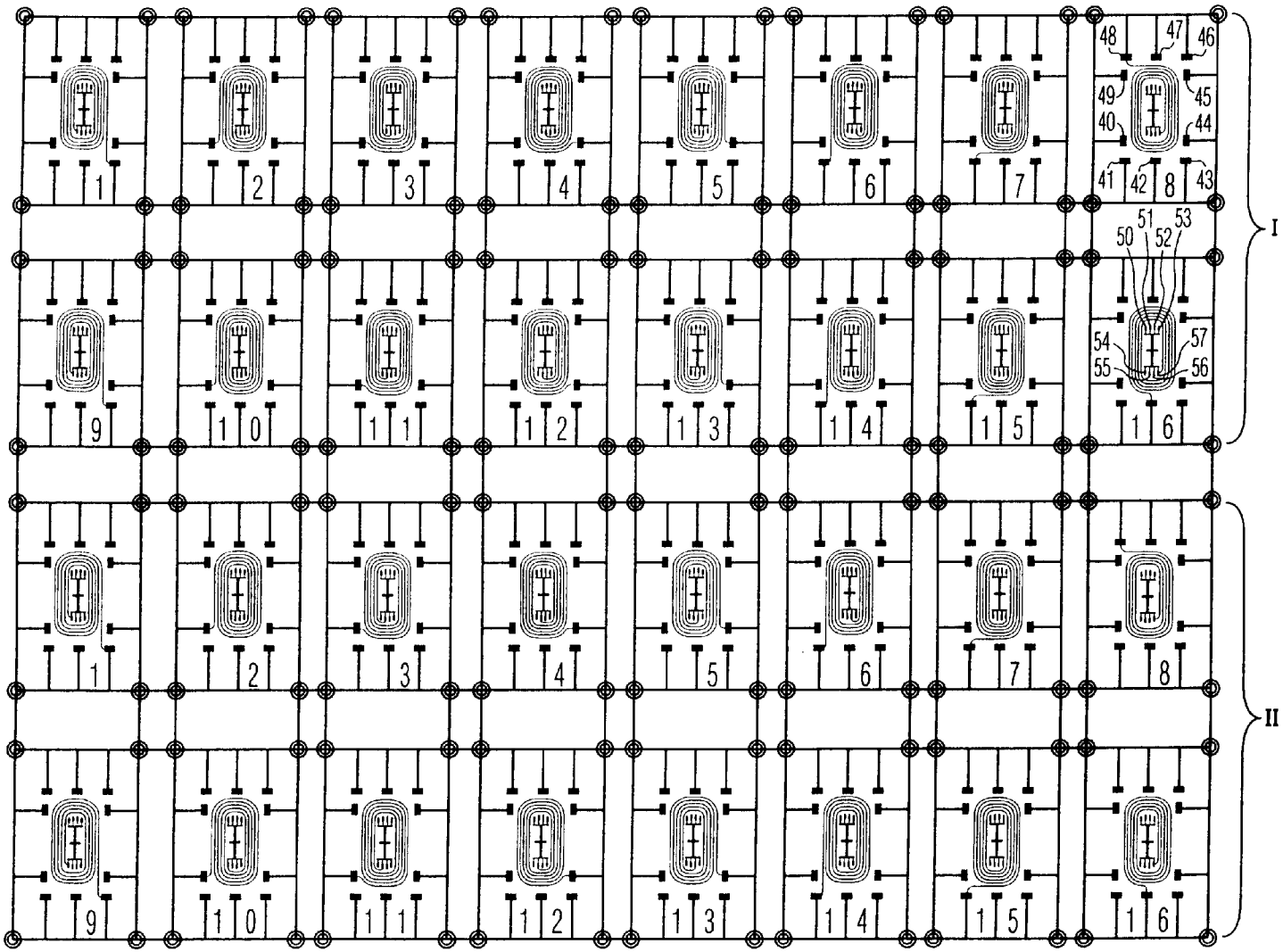
FIG. 2 is a plan view of a copper foil sheet having two sets of sixteen windings for two different winding structures of the invention.

Preferably, all layers contain an identical pattern of contact pads 40–57 around the inner and outer periphery of the winding layers, as shown in FIG. 2, of which only two in each layer are used to provide interconnection to other layers. The remaining pads provide structural support to prevent deformation of the layers during pressing and curing of the filler material to densify and rigidify the stack during manufacturing.

The space "d" between the end walls 5, 6 of core center leg 15 and the inner sidewalls 4 of the winding body 18 contains a dielectric potting compound 37, which may also be epoxy, and which fixes the space d, thus preventing creep and insuring against electrical discharges between the coil and the core.

The layers of insulating material and winding patterns may be conveniently provided by starting with a sheet of commercially available flex foil, consisting of a 1 mil thick polyimide sheet supporting a copper foil approximately 4 to 5 mils thick. If the desired thickness of copper is not readily available, additional copper may be deposited, for example, by electroplating, to build up the layer to the desired thickness. The compactness and rigidity of the final structure enables such thicknesses, which in turn enables formation of conductive tracks having a sufficient cross section to carry the current needed for high power applications.

The winding patterns made up of the conductive tracks are formed by selectively etching the foil to remove the unwanted portions of the copper layer. FIG. 2 shows such a flex foil sheet containing two exemplary sets, of sixteen winding patterns, one set for a first inductor, and a second set for a second inductor.

The individual winding layers are then cut from the sheet, and assembled into a stack using the alignment holes "H" in the corners of the layers. In each of the two sets, the first 8 winding layers are stacked in the sequence 1, 2 . . . 8, after which the last 8 layers are rotated 180 degrees in the plane of the sheet as shown in FIG. 2, before being stacked in the sequence 9, 10 . . . 16.

Prior to stacking, each winding layer is coated with a binding fluid, eg., dipped in epoxy. After stacking, the binder-coated stack is pressed to remove excess liquid. Ideally, only a very thin layer of binder should remain between the upper surfaces of the conductive tracks of the winding pattern and the lower surface of the insulating sheet above it, to insure maximum density of the stack. In the case of epoxy as the binder, the stack is then cured by heating to about 60 degrees C. for about 1 hour.

As will be appreciated, an alternate assembly method would involve laying out the individual winding layers in each sheet in a manner so that the sheets could be stacked, and then densified as described above, and then the stack of sheets could be cut to form individual winding bodies.

The resultant winding body is then machined to size, as a result of which the alignment holes are removed, and the input and output termini of the individual winding patterns are revealed in the sidewall of the body. Contacts are then applied, eg, by electroless plating, to interconnect the winding patterns of individual layers, and to provide for external connection as well. Plating contacts onto the exterior surface is much simpler to accomplish than internal via plating and soldering, and occupies little space, thus maintaining the desired density and low profile of the device.

During machining, slots 38 and 39 are formed in two opposite sides of the winding body, of a dimension to accommodate outer legs 14 and 16 of the core body. The slots have dimensions and placement to result in a predetermined core-winding spacing d, thereby to insure a minimum distance between the interior contacts 35 and 36 and the end walls 5 and 6 of the core center leg 15.

As will be appreciated from studying FIGS. 1*c* and 2, in this embodiment each plated contact usually interconnects no more than two winding layers. These layers need not be directly adjacent to one another.

The completed winding body is then placed between the upstanding legs of an "E" core, in a manner to maintain the required distance d between the core legs and the body, after which the upper "I" core is glued or clamped to the lower "E" core, and the spaces between the core and coil are filled with a potting compound, eg, epoxy.

The completed circuit component may be mounted on a PC board as shown in FIG. 1*a*, for example, by inserting the core into a cut-out in the PC board, and then soldering the component input and output contacts to pads (not shown) on the PC board. Due to the planarity and the low profile of the device including the contacts, as well as to the solder connections, significant areas of intimate contact exist between the component and the board, resulting in an enhancement of the conduction of heat from the component to the PC board.

The invention has been necessarily described in terms of a limited number of embodiments and variations. Other embodiments and variations of embodiments will become apparent to those skilled in the art, and are intended to be encompassed within the scope of the appended claims. For example, while the core has been described herein as having a rectilinear shape resulting from the assembly of "E" and "I" sections, it could also have other shapes consistent with a planar structure, such as a cylindrical shape.

What I claim as my invention is:

1. A winding body for a low profile magnetic component, the winding body having an upper surface, a lower surface, an outer sidewall, and an inner sidewall defining a central aperture extending from said upper surface to said lower surface;

the body being constituted by a stack of substantially planar layers, each layer having a planar winding pattern formed by a continuous track of electrically conductive material, each said track having at least two turns and ends terminating at respective sidewalls of the body, and an electrically insulating binding material between the turns of each track; and plated metal interconnections selectively formed on the sidewalls of the body, said interconnections on the inner and outer sidewalls serving to directly interconnect the winding pattern on each respective layer to a winding pattern on at least one other of said layers as well as to provide for external connections to the winding patterns of the layers connected thereto.

2. The winding body of claim 1 in which the plated metal interconnectors on the sidewalls are electroless plated.

3. The winding body of claim 1 in which the winding body has indented portions for accommodating upstanding portions of a magnetic core, and for establishing a predetermined distance between the body and the core.

4. The winding body of claim 1 in which the winding material is copper.

5. The winding body of claim 1 in which the insulating material is polyimide.

6. The winding body of claim 1 in which the binding material is epoxy.

7. A low profile magnetic component comprising a core and the winding body of claim 1.

8. The low profile magnetic component of claim 7 in which the core comprises at least two core components having mutually facing planar surfaces.

9. The low profile magnetic component of claim 8 in which the core comprises a lower core component having a planar portion and three spaced-apart upstanding portions having planar upper surfaces, the upstanding portions defining spaces to accommodate the winding body, the core also comprising an upper core component having a planar lower surface.

10. A low profile magnetic component as claimed in claim 7, wherein said core has a center leg which extends through said central aperture.

11. The winding body of claim 1 in which a plurality of pads of conductive material are positioned on each layer and each track ends is electrically connected to one of these pads.

12. The winding body of claim 11 in which a first plurality of said pads extends into the inner sidewall, and in which a second plurality of said pads extends into the outer sidewall.

13. The winding body of claim 12 wherein all layers have an identical pattern of contact pads at both the inner and outer sidewalls.

14. The winding body of claim 13 wherein each contact pad is aligned with and connected to a respective contact pad of each adjacent layer.

15. The winding body of claim 14 wherein only two contact pads in each layer are electrically connected to winding patterns in other layers.

16. The winding body of claim 11 wherein said pads of conductive material have the same thickness as the winding pattern.

* * * * *